United States Patent [19]

Lazarus et al.

[11] 4,280,018

[45] Jul. 21, 1981

[54] INTEGRATED PIEZOELECTRIC SOUND TRANSDUCER AND PREAMPLIFIER

[75] Inventors: Arnold Lazarus, San Francisco; Stuart L. Weiss, Boulder Creek, both of Calif.

[73] Assignee: Strobotronix, Inc., San Francisco, Calif.

[21] Appl. No.: 38,555

[22] Filed: May 14, 1979

[51] Int. Cl.[3] ..... G10H 5/00

[52] U.S. Cl. ..... 179/1 M; 179/1 A; 179/110 A

[58] Field of Search ..... 179/1 M, 1 A, 110 A, 179/100.4 A

[56] References Cited

U.S. PATENT DOCUMENTS

| | | | |
|---|---|---|---|
| 3,405,288 | 10/1968 | Dittrich | 179/110 A |
| 3,701,865 | 10/1972 | Carlson et al. | 179/110 A |

FOREIGN PATENT DOCUMENTS

| | | | |
|---|---|---|---|
| 7313654 | 4/1974 | Netherlands | 179/110 A |

*Primary Examiner*—Bernard Konick
*Assistant Examiner*—Joseph A. Popek
*Attorney, Agent, or Firm*—Freilich, Hornbaker, Wasserman, Rosen & Fernandez

[57] ABSTRACT

An integrated piezoelectric sound transducer and preamplifier is provided within a sealed enclosure and the preamplifier is powered through a coaxial cable utilized for the AC signal output of the preamplifier. By integrating the transducer and preamp, cable noise is eliminated. The preamplifier is implemented with a single FET connected in a source-follower configuration. The gate of the FET is connected to circuit ground through the internal resistance of the piezoelectric material and mass of the transducer, and the drain of the FET is connected to an external power supply through the internal conductor of the coaxial cable that is AC coupled to the source of the FET by a capacitor. In the case of bipolar power supplies over the coaxial cable, the source is connected to either circuit ground or the other polarity of power through a separate diode and filter capacitor. A multiplexing switch receives the two power supply voltages while transmission of the audio signal from the transducer takes place while either power supply voltage is received. A filter in the enclosure isolates the AC signal on the cable from the drain.

5 Claims, 3 Drawing Figures

INTEGRATED PIEZOELECTRIC SOUND TRANSDUCER AND PREAMPLIFIER

BACKGROUND OF THE INVENTION

This invention relates to a transducer for converting vibrations from musical instruments, especially ones having a resonant cavity, into high fidelity electrical signals for amplification and reproduction of musical sounds, and more particularly to such a transducer with an integral preamplifier contained within the enclosure of the transducer.

Piezoelectric materials have been used to produce electrical signals from vibrations in general, and of musical instruments in particular. The most common have been a type employing polarized ferrelectric ceramics, such as barium titanate or lead titanate zirconate, which is placed on the conductive wall in an enclosure with the axis of polarization in a direction normal to the wall. A conductive inertia body is then placed on the piezoelectric material and an electrical signals lead is connected to the inertia body. This lead is normally connected to the inerconductor of a coaxial cable which is plugged into a power amplifier.

The signals from a piezoelectric transducer are of sufficient amplitude to transmit over a coaxial cable of significant length to a power amplifier, but since a piezoelectric transducer has a very high impedance, typically on the order of 600 megohms, an impedance matching stage is required at the input of the power amplifier. That is not a problem since there are techniques that can be readily used to provide an impedance matching preamplifier. For example, a field-effect transistor (FET) has an input impedance of that order of magnitude so that it can be used in a source-follower configuration to provide impedance matching. The problem is that the cable from the transducer to the preamplifier introduces noise into the system. This cable noise is caused by the flexing of the cable, which changes the capacitance of the cable. The preamplifier amplifies this cable noise along with the low level transducer signal. It would be desirable to improve the signal to noise ratio of the preamplifier output by amplifying the signal and not the cable noise.

An object of this invention is to increase the signal to noise ratio of the preamplifier output for a transducer coupled to a power amplifier by a cable. These and other objects of the invention are achieved by integrating an impedance matching preamplifier for a piezoelectric transducer within the case of the transducer with a total size and weight for the integrated transducer and preamplifier so minimal as to not affect the vibration modes of the musical instrument to which the transducer is attached.

In accordance with the present invention an integrated piezoelectric sound transducer and preamplifier is provided within a sealed enclosure adapted to be mounted directly on a vibrating wall of a musical instrument, particularly the wall of an instrument having a resonant cavity. The amplifier is a single field-effect transistor (FET) connected in a common-drain (source-follower) configuration with the piezoelectric transducer connected between the gate and circuit ground inside the enclosure. The internal conductor of a coaxial cable is AC coupled to the source of the FET by a capacitor within the enclosure. The internal conductor of a coaxial cable is AC coupled to the source of the FET by a capacitor within the enclosure. DC bias voltage for the FET drain is provided through the internal conductor of the coaxial cable with a filter connected between the drain and circuit ground. The outer conductor of the cable is connected to the circuit ground of the enclosure. At the other end of the cable, the inner conductor is AC coupled by a capacitor to the input of a power amplifier, and connected to a DC power source. In that manner power for the integrated transducer and FET preamplifier within the enclosure is provided through the signal cable. Bipolar power supply may also be provided by using multiplexing switches of alternately transmit power of polarity and the other polarity. A separate diode and filter capacitor is provided to filter the power supply of the other polarity for bias voltage to be connected to the source-follower resistor.

DESCRIPTION OF PREFERRED EMBODIMENTS

Figure 1:
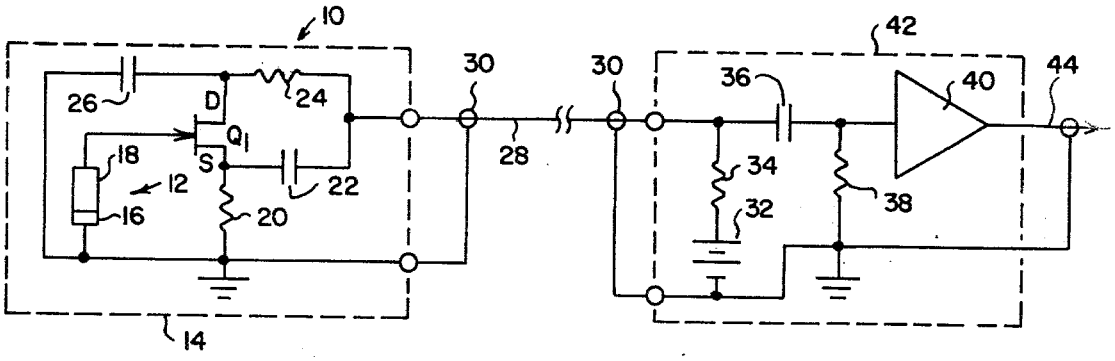
FIG. 1 is a schematic diagram of a preferred embodiment.

Referring now to FIG. 1, a piezoelectric transducer 10 is shown as having a piezoelectric accelerometer 12 within an enclosure 14. The accelerometer is comprised of a small piezoelectric element 16 of ferroelectric ceramic material polarized to exhibit a strong piezoelectric effect to stresses and strains in a vertical direction as viewed in the drawing. The element 16 is placed in direct low resistance contact with the inside of the enclosure 14. In practice, the enclosure is made in the form of a rectangular shell out of epoxy. The inside of the shell is then clad with copper. A suitable conductive cement is used to secure the disc 16 to the shell. Then a conductive inertia body 18 is similarly cemented to the disc. The body has connected to it a conductive lead connected to the gate of an n-channel field-effect transistor $Q_1$, which lead may be a connector pin for the transistor. Other components consisting of a load resistor 20 and capacitor 22 connected to the source of the transistor and an RC filter consisting of a resistor 24 and capacitor 26, are connected to the drain of the transistor. The capacitor 22 and resistor 24 are connected to the inner conductor 28 of a coaxial cable. The outer conductor 30 is connected to the copper clad wall of the shell which functions as circuit ground for the integrated vibration (sound) transducer and preamplifier.

The inner conductor 28 of the cable is connected to a source of DC power (battery) 32 by a resistor 34 that matches the resistor 20 (typically 10 Kohms). This provides DC bias voltage for the transistor. The capacitor 26 is selected to be sufficiently large to filter any AC components out of the DC voltage applied to the drain. The gate of the transistor is biased by the internal resistance of the transducer (disc 16 and inertia body 18) which provides the input signal to the gate. The output signal at the source is AC coupled by the capacitor 22 to the inner conductor 28 of the coaxial cable. In that manner a minimum number of components are used to provide a preamplifier integrated with the transducer in the shell 14.

Once all of the components are thus assembled in the shell, the shell is filled with silicon rubber, and the open side of the shell is sealed with epoxy. The total size of the shell need be no more than $\frac{3}{8}\times\frac{3}{8}\times 1$ inches, and the total weight is less than 3 grams.

At the other end of the cable, the inner conductor 28 is AC coupled by a capacitor 36 and resistor 38 to the input terminal of an optional voltage amplififer 40 in an enclosure 42. The voltage amplifier may have a low input impedance of about 15 Kohms which is matched by the impedance of the cable. The input impedance presented to the transistor $Q_1$ in the preamplifier by the transducer is typically 600 Mohms, but the source-follower configuration of the preamplifier matches the high input impedance to the low output impedance.

Although the inner conductor 28 is shown connected directly to the power supply and voltage amplifier circuit in the enclosure 42, in practice the connection would be made through a phone plug and jack. The "pickup" for the musical instrument would thus consist of simply the very small and light transducer and small diameter cable which plugs into the power amplifier. The voltage amplifier could itself be a multistage preamplifier for a power amplifier, such as a 100 watt amplifier, in which case the output would be connected to the inner conductor 44 of another coaxial cable that plugs into the power amplifier. In either case the integrated transducer and impedance matching preamplifier in the enclosure 14 would both receive power and transmit audio signals over the same coaxial cable plugged into a larger enclosure which contains a power supply and an amplifier stage or stages.

Figure 2:
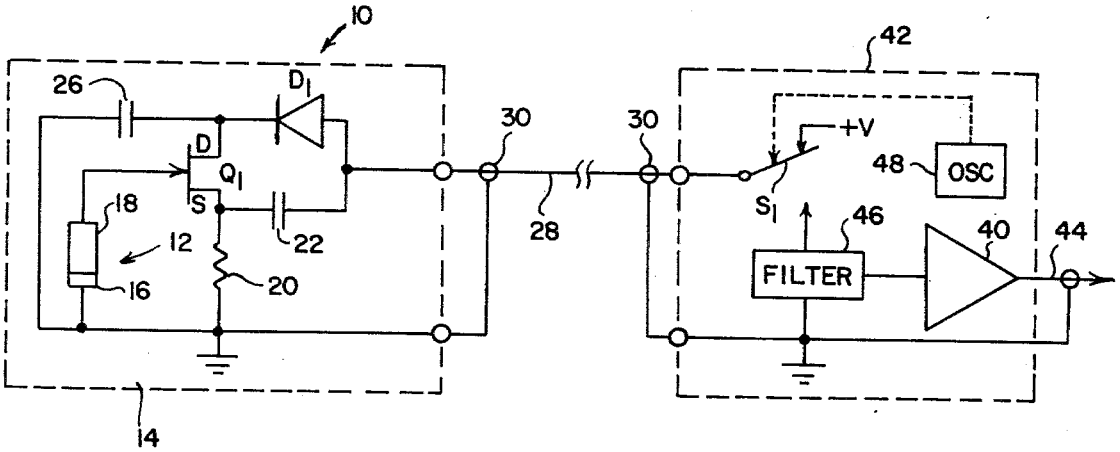
FIG. 2 is a schematic diagram of a second embodiment.

In place of the resistor 34 and capacitor 36 for connecting the DC power supply to the inner conductor of the cable and for AC coupling the audio signals to the amplifier 40, it would be possible to use multiplexing techniques as shown in FIG. 2 using a switch $S_1$. Although shown schematically as an ideal switch, it would in practice be implemented with electronic devices, such as transistors. This would chop the DC power supplied to the transistor $Q_1$, but a diode $D_1$ (in place of the resistor 24 of FIG. 1) and the filter capacitor 26 would provide a steady DC voltage to the drain of the transistor. The capacitor 36 and resistor 38 of FIG. 1 would be replaced by a passive or active filter network 46 designed to filter the switching frequency set by an oscillator 48 and pass only the audio signal.

Figure 3:
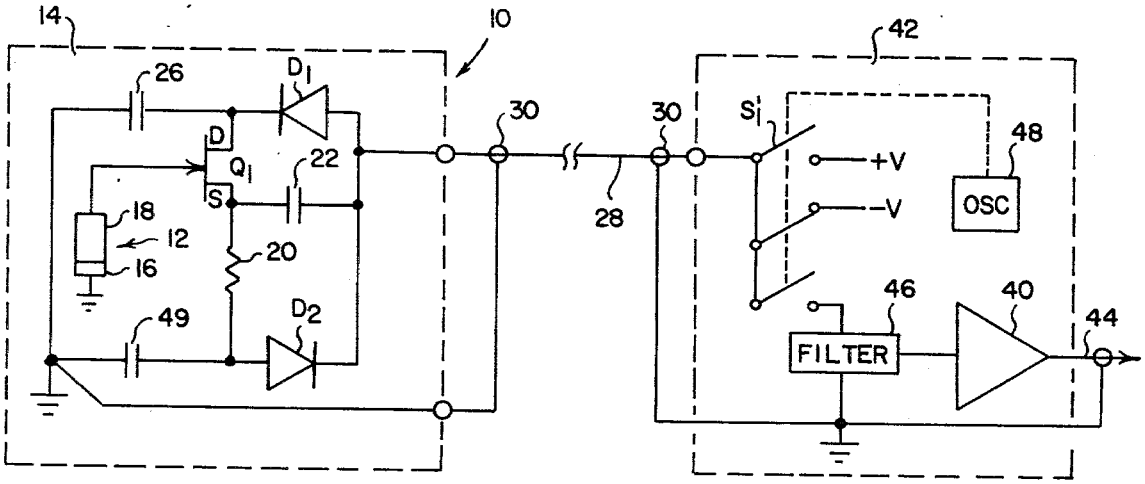
FIG. 3 is a schematic diagram of a third embodiment.

FIG. 3 illustrates a variant of the embodiment in FIG. 2 in which the same reference numerals are retained for the same components, and the same reference numerals primed for similar components. It provides a bipolar power supply through a diode $D_2$ and capacitor 49. A switch $S_1$ has three contacts (or the equivalent in the case of electronic switching devices) to provide $+V$ and $-V$ power, alternately to the transducer and preamplifier. Bipolar power supplies increase voltage across the source resistor 20 so that the transducer signal is a smaller percentage of that power supply voltage. The change in current ($\Delta I$) in the transistor resulting from the signal voltage is thus reduced, resulting in lower distortion. This power multiplexing technique can be used with single or triple axis transducers, and allows use of standard two-wire cable for better cable availability and field repairability as in the case of single power multiplexing (FIG. 2).

In each of these embodiments there is an advantage to placing the prezoelectric transducer within the case of the transducer, which is that with no cable between the piezoelectric transducer and preamplifier, there is virtually no capacitance to cause any voltage dividing of the signal picked up. That will significantly improve the signal to noise ratio of the preamplifier output for a transducer coupled to a power amplifier by a cable, which is an object of this invention.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An integrated piezoelectric sound transducer and preamplifier within a single enclosure adapted to be affixed to a resonant cavity of a musical instrument comprising a field-effect transistor having a source, a drain and a gate, said transistor being connected with a source resistor connected in a source-follower configuration, with said sound transducer connected in series between said gate and the outer conductor of a coaxial cable to both provide DC bias for said gate and provide audio signals produced by said transducer to said gate, said drain being connected to the outer conductor of said coaxial cable through a capacitor and to an inner conductor of said coaxial cable through an impedance device for receiving DC power over said inner conductor, said source being coupled to the inner conductor of said coaxial cable by a capacitor and to the outer conductor of said coaxial cable by said source resistor.

2. The combination of claim 1 wherein said impedance device is a resistor and said DC power is supplied to said inner conductor of said cable as a constant DC voltage.

3. The combination of claim 1 wherein said impedance device is a diode and said DC power is supplied to said inner conductor of said cable as a chopped DC voltage.

4. The combination of claim 3 including in a separate enclosure a power amplifier connected to said coaxial cable for receiving said audio signals wherein said chopped DC voltage is provided through switch means which alternately connects said inner conductor to a a source of DC power and said power amplifier.

5. The combination of claim 4 wherein said switch means is alternately connected between a source of power of one polarity and a source of power of opposite polarity including a second diode connected in series between said inner conductor and a source resistor of said field-effect transistor connected in a source follower configuration, said second diode being polarized opposite said first diode for bipolar power supply to said field-effect transistor, a second capacitor connected between circuit ground and the junction of said second diode and said source resistor.

* * * * *